US009858891B2

(12) United States Patent
Ohe

(10) Patent No.: US 9,858,891 B2
(45) Date of Patent: Jan. 2, 2018

(54) DISPLAY CONTROL APPARATUS AND DISPLAY CONTROL METHOD TO DETECT TEMPERATURE OF DISPLAY REGION

(71) Applicant: Sony Corporation, Tokyo (JP)

(72) Inventor: Takayuki Ohe, Saitama (JP)

(73) Assignee: SONY CORPORATION, Tokyo (JP)

( * ) Notice: Subject to any disclaimer, the term of this patent is extended or adjusted under 35 U.S.C. 154(b) by 150 days.

(21) Appl. No.: 13/899,999

(22) Filed: May 22, 2013

(65) Prior Publication Data

US 2013/0321387 A1 Dec. 5, 2013

(30) Foreign Application Priority Data

Jun. 1, 2012 (JP) ..... 2012-126053

(51) Int. Cl.
*G09G 5/10* (2006.01)

(52) U.S. Cl.
CPC ..... *G09G 5/10* (2013.01); *G09G 2300/0413* (2013.01); *G09G 2320/041* (2013.01); *G09G 2320/0686* (2013.01); *G09G 2320/103* (2013.01)

(58) Field of Classification Search
CPC ..... G09G 2300/0413; G09G 2320/041; G09G 2320/0686; G09G 2320/103
USPC ..... 345/204, 214
See application file for complete search history.

(56) References Cited

U.S. PATENT DOCUMENTS

| | | | | |
|---|---|---|---|---|
| 2008/0290806 | A1* | 11/2008 | Tada et al. | 315/169.1 |
| 2008/0297055 | A1* | 12/2008 | Miyake et al. | 315/169.2 |
| 2010/0265228 | A1 | 10/2010 | Kimura et al. | |
| 2011/0210251 | A1* | 9/2011 | Onakado et al. | 250/332 |
| 2011/0242143 | A1 | 10/2011 | Yamashita et al. | |
| 2011/0248975 | A1 | 10/2011 | Takuma | |
| 2011/0279442 | A1* | 11/2011 | Hage et al. | 345/214 |

FOREIGN PATENT DOCUMENTS

| | | |
|---|---|---|
| JP | 2010-250171 A | 11/2010 |
| JP | 2011-209480 A | 10/2011 |
| JP | 2011-221305 A | 11/2011 |

* cited by examiner

*Primary Examiner* — Viet Pham
(74) *Attorney, Agent, or Firm* — Chip Law Group

(57) ABSTRACT

There is a display control apparatus including a dummy pixel region provided in a region different from a display region in which various images are displayed, and a temperature detector detecting a temperature of the dummy pixel region.

13 Claims, 9 Drawing Sheets

DISPLAY CONTROL APPARATUS AND DISPLAY CONTROL METHOD TO DETECT TEMPERATURE OF DISPLAY REGION

CROSS-REFERENCE TO RELATED APPLICATION

The present application claims priority from Japanese Patent Application No. JP 2012-126053 filed in the Japanese Patent Office on Jun. 1, 2012, the entire content of which is incorporated herein by reference.

BACKGROUND

The present disclosure relates to a display control apparatus, a display control method, a program and a recording medium.

Technologies of providing a display region and a dummy pixel region in a display panel and detecting luminance of the dummy pixel region are disclosed in Japanese Patent Laid-Open No. 2010-250171, Japanese Patent Laid-Open No. 2011-209480 and Japanese Patent Laid-Open No. 2011-221305.

SUMMARY

Japanese Patent Laid-Open No. 2010-250171, Japanese Patent Laid-Open No. 2011-209480 and Japanese Patent Laid-Open No. 2011-221305, however, do not mention any temperature of the display region. Therefore, a technology enabling to detect the temperature of the display region accurately has been desired.

According to an embodiment of the present disclosure, there is provided a display control apparatus including a dummy pixel region provided in a region different from a display region in which various images are displayed, and a temperature detector detecting a temperature of the dummy pixel region.

According to an embodiment of the present disclosure, there is provided a display control method including inputting a signal for temperature detection in a dummy pixel region provided in a region different from a display region in which various images are displayed, and adjusting a signal level of a pixel signal input in a pixel of the display region, on the basis of a temperature of the dummy pixel region.

According to an embodiment of the present disclosure, there is provided a program for causing a computer to implement a drive function of inputting a signal for temperature detection in a dummy pixel region provided in a region different from a display region in which various images are displayed, and an adjustment function of adjusting a signal level of a pixel signal input in a pixel of the display region, on the basis of a temperature of the dummy pixel region.

According to an embodiment of the present disclosure, there is provided a computer-readable recording medium having the above-mentioned program recorded thereon.

According to the embodiment of the present disclosure, the temperature of the dummy pixel region can be detected. Therefore, since the temperature of the display region can be predicted on the basis of the temperature of the dummy pixel region according to the embodiment of the present disclosure, the temperature of the display region can be detected accurately.

According to the embodiments of the present disclosure described above, the temperature of the dummy pixel region can be detected. Therefore, since the temperature of the display region can be predicted on the basis of the temperature of the dummy pixel region according to the embodiment of the present disclosure, the temperature of the display region can be detected accurately.

DETAILED DESCRIPTION OF THE EMBODIMENTS

Figure 1:
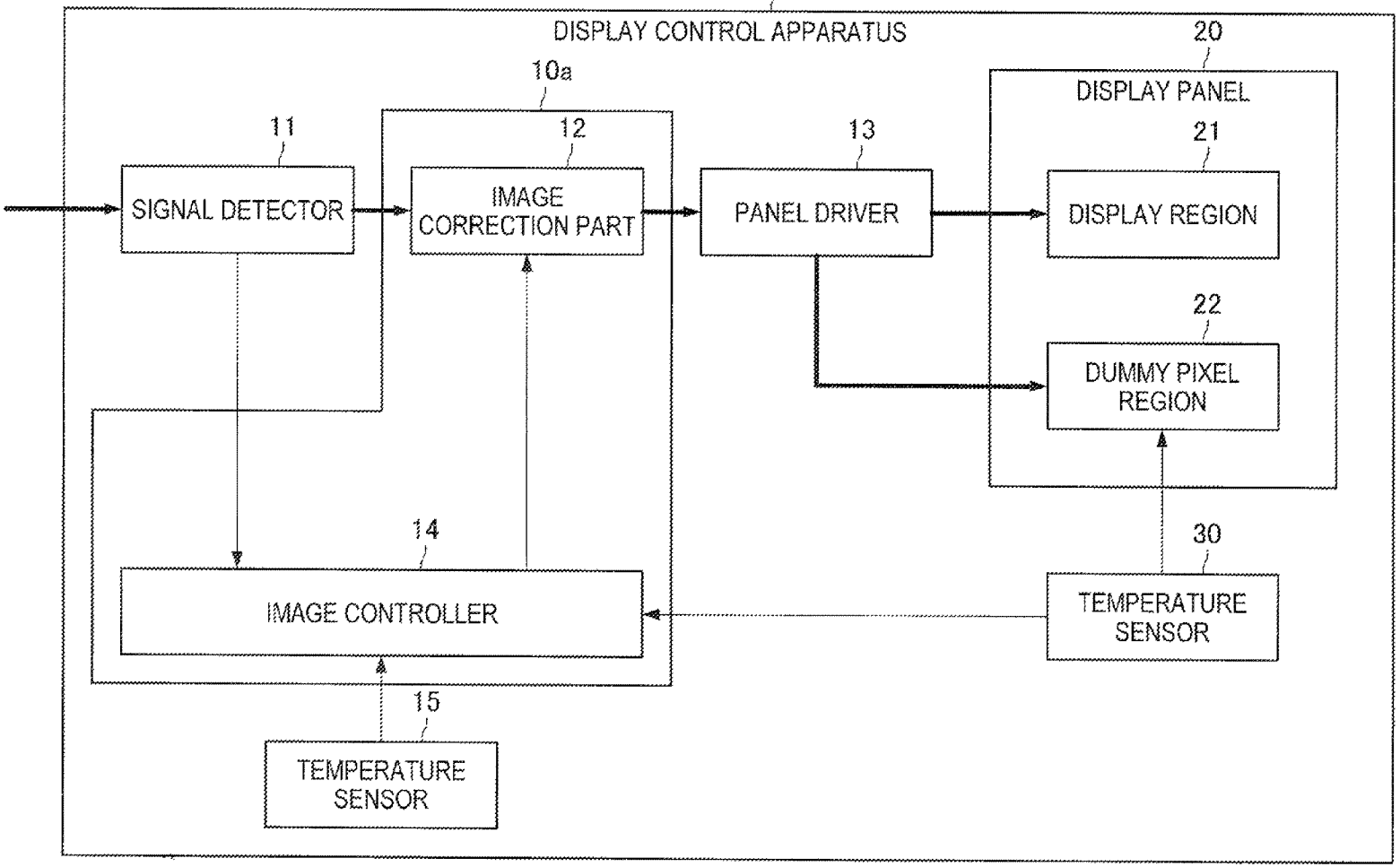
FIG. 1 is a block diagram illustrating a configuration of a display control apparatus according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Incidentally, the description is made in the following order.

1. Study on Display Control Apparatuses
2. First Embodiment
2-1. Configuration of Display Control Apparatus
2-2. Procedure of Processing by Display Control Apparatus
2-3. Variation
3. Second Embodiment
3-1. Configuration of Display Control Apparatus
3-2. Procedure of Processing by Display Control Apparatus
4. Third Embodiment
4-1. Configuration of Display Control Apparatus
4-2. Procedure of Processing by Display Control Apparatus
4-3. Variation

1. Study on Display Control Apparatuses

The inventors have been studying display control apparatuses, especially, display control apparatuses using a self-emitting device (for example, organic EL displays) and devised a display control apparatus according to embodiments. Hence, the study conducted by the inventors will be described first.

Figure 12:
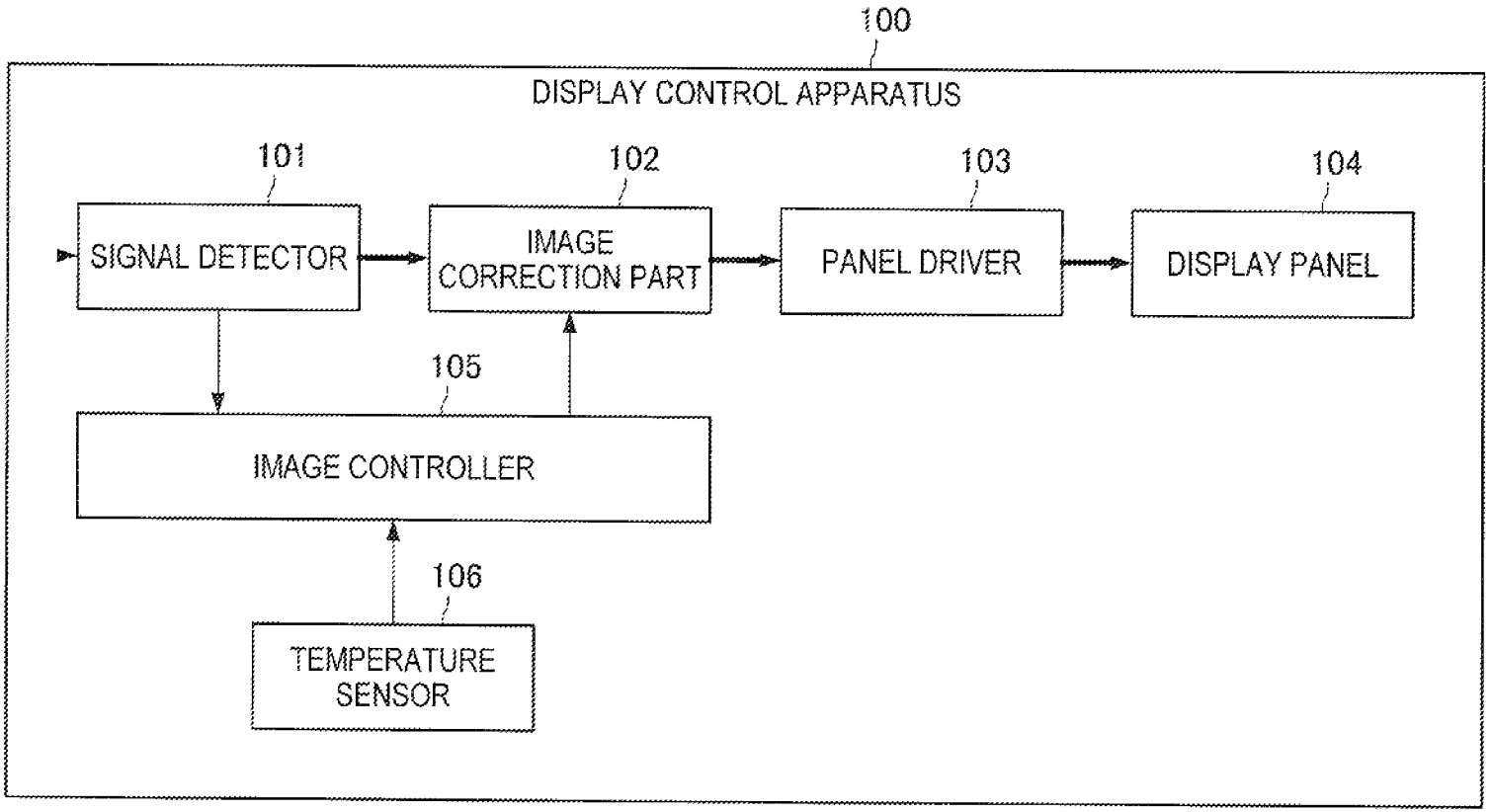
FIG. 12 is a block diagram illustrating a configuration of a display control apparatus performing processing on the basis of environmental temperature.

Since a display control apparatus using a self-emitting device presents different light emission efficiency and/or characteristics of time-series change in luminance depending on temperature, there is proposed a technology of measuring an environmental temperature of the circuit board (for example, an internal temperature of the display control apparatus) and correcting an image signal. FIG. 12 illustrates a display control apparatus 100 to which the technology is applied. The display control apparatus 100 includes a signal detector 101, an image correction part 102, a panel driver 103, a display panel 104, an image controller 105 and a temperature sensor 106.

The signal detector 101 detects an image signal and outputs it to the image correction part 102 and image controller 105. The image correction part 102 corrects luminance of the image signal and the like on the basis of correction information given from the image controller 105, and outputs the image signal after the correction to the panel driver 103. The panel driver 103 inputs the image signal after the correction in the display panel 104. The display panel 104, which is a so-called self-emitting device (self-emitting display panel), displays an image according to the image signal. The image controller 105 determines a correction value of the image signal on the basis of environmental temperature information from the temperature sensor 106, and outputs the correction information regarding the correction value to the image correction part 102. The temperature sensor 106 is provided in the circuit board and measures an environmental temperature of the circuit board. Then, the temperature sensor 106 outputs the environmental temperature information regarding the environmental temperature to the image controller 105. Accordingly, the display control apparatus 100 corrects the image signal on the basis of the environmental temperature.

Japanese Patent Laid-Open No. 2010-250171, Japanese Patent Laid-Open No. 2011-209480 and Japanese Patent Laid-Open No. 2011-221305 mentioned above discloses technologies of providing a display region and a dummy pixel region in a display panel and detecting luminance of the dummy pixel region. These technologies are for preventing burn-in of the display panel, in which technologies luminance of an image signal input in the display region is adjusted on the basis of the luminance of the dummy pixel region.

Meanwhile, since the display region (region in which various images are displayed, within the display panel) in the display control apparatus can be touched by the user, the maximum value of the absolute temperature (temperature of the display region) is often regulated strictly. Therefore, the temperature of the display region is expected to be suppressed not more than a predetermined value.

The technologies disclosed in Japanese Patent Laid-Open No. 2010-250171, Japanese Patent Laid-Open No. 2011-209480 and Japanese Patent Laid-Open No. 2011-221305 mentioned above are for preventing burn-in of the display region, and for the purpose, detecting the luminance of the dummy pixel region. Namely, Japanese Patent Laid-Open No. 2010-250171, Japanese Patent Laid-Open No. 2011-209480 and Japanese Patent Laid-Open No. 2011-221305 do not mention any temperature of the display region or the dummy pixel region. Accordingly, in the technologies disclosed in Japanese Patent Laid-Open No. 2010-250171, Japanese Patent Laid-Open No. 2011-209480 and Japanese Patent Laid-Open No. 2011-221305, the temperature of the display region is difficult to be suppressed not more than a predetermined value.

Technologies of suppressing the temperature of the display region not more than a predetermined value can include a technology of directly measuring the temperature of the display region. A distribution of the temperature of the display region, however, is not uniform but large in temperature gradient. Moreover, the temperature of the display region is much affected by the heat from the electric circuit board attached on the rear face of the panel. Accordingly, directly measuring the temperature of the display region expects many temperature sensors on the rear face of the display region. Hence, such measurement of the temperature of the display region costs much.

In addition, technologies of making the temperature of the display region uniform can include a technology of providing, in the display panel, additional elements for diffusing the temperature of the display region to make it uniform. Such elements can employ, for example, a heat pipe, a temperature diffusion sheet and the like. Yet in the technology, however, the temperature of the display region is difficult to be made uniform sufficiently. Hence, many temperature sensors are still expected, and the additional elements besides. Accordingly, the technology takes further more costs.

Also, application of a technology of performing correction on the basis of environmental temperature is also considered for suppressing the temperature of the display region not more than a predetermined value. In the technology, the worst image signal (having the highest luminance among all the pixels or a part of the pixels) is first input in the display region, and the environmental temperature and the temperature of the display region at this stage are measured. Then, a difference Δ between the temperature of the display region and the environmental temperature is calculated. Then, with the environmental temperature monitored, when the value obtained by adding the difference Δ to the environmental temperature exceeds a predetermined value, the luminance of the image signal is reduced. Accordingly, as a premise, the technology expects that the worst image signal is input in the display region.

Since the luminance of the image signal actually input in the display region is equal to or smaller than the luminance of the worst image signal, the temperature of the display region is lower than the value obtained by adding the difference Δ to the environmental temperature in most of the cases. In the technology, nevertheless when the value obtained by adding the difference Δ to the environmental temperature exceeds the predetermined value, the luminance of the image signal is reduced. Thus, in the technology, the luminance of the image signal is often reduced excessively. Accordingly, the technology is difficult to attain accurate control of the temperature of the display region.

Suppose that the environmental temperature upon inputting the worst image signal is 40° C. and the temperature of the display region is 60° C., and that the predetermined value is 55° C., for example. In this case, the difference Δ is 20° C. Meanwhile, there is a case where even an image signal except the worst one results in the environmental temperature of 40° C. In this case, the temperature of the display region is less than 60° C. (for example, can be approximately 50° C.) Since the value obtained by adding the difference Δ to the environmental temperature exceeds the predetermined value, the technology leads to reduction of the luminance of the image signal also even in this case. Thus, in the technology, the luminance of the image signal is often reduced excessively.

Technologies of preventing the luminance of the image signal from being excessively reduced can include a technology of selecting controls according to whether or not the image signal input in the display region is worst. However, in the technology, when the image signal input in the display region is not worst, the temperature of the display region is difficult to be controlled.

Moreover, technologies of controlling the temperature of the display region can include estimating a correlation between the environmental temperature and the temperature of the display region. However, such correlation between the environmental temperature and the temperature of the display region is not easy to be estimated.

For these reasons, the above-mentioned technologies have not attained accurate control of the temperature of the display region. Thus, the inventors have been focusing on the technology of detecting the temperature of the dummy pixel region, and devised the technology according to the embodiments. The technology according to the embodiments can attain accurate control of the temperature of the display region. Namely, in the technology according to the embodiments, the luminance of emitted light can be adjusted to a more appropriate value according to the temperature of the display region (that is, the actual temperature of the screen). Moreover, since the additional elements or temperature sensors of the display region as mentioned above do not have to be provided, costs can be reduced. Hereafter, the embodiments are described.

2. First Embodiment

[2-1. Configuration of Display Control Apparatus]

Next, a configuration of a display control apparatus 10 according to a first embodiment is described on the basis of FIG. 1 to FIG. 5. The display control apparatus 10 includes a signal detector 11, an image correction part 12, a panel driver 13, an image controller 14, temperature sensors 15 and 30 and a display panel 20. In addition, the display control apparatus 10 has a hardware configuration of a CPU, a ROM, a RAM, a hard disk drive, a display panel, temperature sensors, and the like. The ROM records a program for implementing the signal detector 11, image correction part 12, panel driver 13 and image controller 14 in the display control apparatus 10. The CPU reads out and executes the program recorded in the ROM. Accordingly, such a hardware configuration implements the signal detector 11, image correction part 12, panel driver 13, image controller 14, temperature sensors 15 and 30 and display panel 20. The image correction part 12 and image controller 14 are included in an adjustment part 10*a*.

In addition, the display control apparatus 10 may not include the display panel 20, specifically, a display region 21. In this case, the display control apparatus 10 is connected to an external display panel 20. Moreover, the display control apparatus 10 may acquire the program from various kinds of recording media. Namely, the program according to the embodiment may be distributed in the state of being recorded in various kinds of recording media.

The signal detector 11 detects an image signal and outputs it to the image correction part 12 and image controller 14. Herein, the image signal is a signal corresponding to one image (frame) and includes a plurality of pixel signals. Each pixel signal represents the position of the pixel and a signal level (specifically, luminance, chromaticity or the like of the pixel).

The image correction part 12 acquires correction information from the image controller 14 and corrects the image signal on the basis of the correction information. Herein, the correction information represents a pixel signal having the highest signal level (hereinafter, referred to also as "peak pixel signal") and a gain coefficient G_Peak. The image correction part 12 extracts the peak pixel signal from the image signal and multiplies the signal level of the peak pixel signal by the gain coefficient G_Peak, and thereby, calculates a correction signal level. Then, the image correction part 12 sets the signal level of the peak pixel signal to the correction signal level. Thereby, the image correction part 12 corrects the image signal. Namely, in the first embodiment, a peak value in signal level is detected on a pixel-by-pixel basis and the relevant peak value is smoothed, and thereby, the image signal is corrected. Thereby, the temperature of the display region 21 is reduced. The image correction part 12 outputs the image signal after the correction to the panel driver 13. Moreover, the image correction part 12 generates a signal for temperature detection having the correction signal level, and outputs it to the panel driver 13.

The panel driver 13 inputs the image signal given from the image correction part 12 in the display region 21. Moreover, the panel driver 13 inputs the signal for temperature detection in the dummy pixel region 22 at the time point when the image signal is input in the display region 21. As above, in the first embodiment, since the largest signal level out of the signal levels in the image signal is input in the dummy pixel region 22, the temperature under the worst conditions can be detected.

The image controller 14 controls the individual constituents of the display control apparatus 10, and in addition, performs the following processing. Namely, the image controller 14 detects the peak pixel signal from the image signal, that is, the image controller 14 detects the highest signal level of the pixel signal.

Then, the image controller 14 acquires dummy temperature information from the temperature sensor 30. The dummy temperature information represents the temperature of the dummy pixel region 22. In addition, at the time point when the image controller 14 acquires the dummy temperature information, the dummy pixel region 22 is generating heat according to a signal for temperature detection input at the previous frame.

Then, the image controller 14 determines whether or not the correction should be performed, on the basis of the dummy temperature information. Specifically, the image controller 14 determines whether or not the temperature of the dummy pixel region 22 is equal to or smaller than a predetermined value (that is, the maximum value of the temperature allowed for the display region 21), on the basis of the dummy temperature information. Then, the image controller 14 determines that the correction should be performed, when the temperature of the dummy pixel region 22 exceeds the predetermined value, because, in this case, the temperature of any area in the display region 21 is possible to exceed the predetermined value. On the other hand, the image controller 14 determines that the correction does not have to be performed, when the temperature of the dummy pixel region 22 is equal to or smaller than the predetermined value.

In addition, the dummy pixel region 22 generates heat according to the signal for temperature detection input at the previous frame, when the image controller 14 acquires the dummy temperature information. Namely, the image controller 14 determines whether or not the correction at the current frame should be performed, on the basis of the heat generation according to the signal for temperature detection at the previous frame.

When it is determined that the correction should be performed, the image controller 14 generates correction information regarding the peak pixel signal and a gain coefficient G_Peak, and outputs it to the image correction part 12. Herein, the gain coefficient G_Peak is a value less than 1. Thereby, the image controller 14 can adjust the signal level of the peak pixel signal.

The value of the gain coefficient G_Peak may be preset, whereas it may be calculated every time. A calculation method of the gain coefficient G_Peak is not specifically limited, but the following method can be considered, for example. Namely, the image controller 14 acquires a table representing correlation between the temperature of the dummy pixel region 22 and the signal level of the signal for temperature detection. This table is stored in the ROM, for example. Then, the image controller 14 acquires a signal level corresponding to a temperature equal to or smaller than the predetermined value from the table, and sets the gain coefficient G_Peak to the value obtained by this signal level divided by the highest signal level. Moreover, the image controller 14 acquires environmental temperature information from the temperature sensor 15. The environmental temperature information represents the environmental temperature of the circuit board. The image controller 14 may determine the gain coefficient G_Peak on the basis of the environmental temperature information as well as the dummy temperature information.

The temperature sensor 15 is provided in the circuit board of the display panel 20 and measures the environmental temperature of the circuit board. Then, the temperature sensor 15 outputs the environmental temperature information regarding the environmental temperature to the image controller 14.

Figure 2:
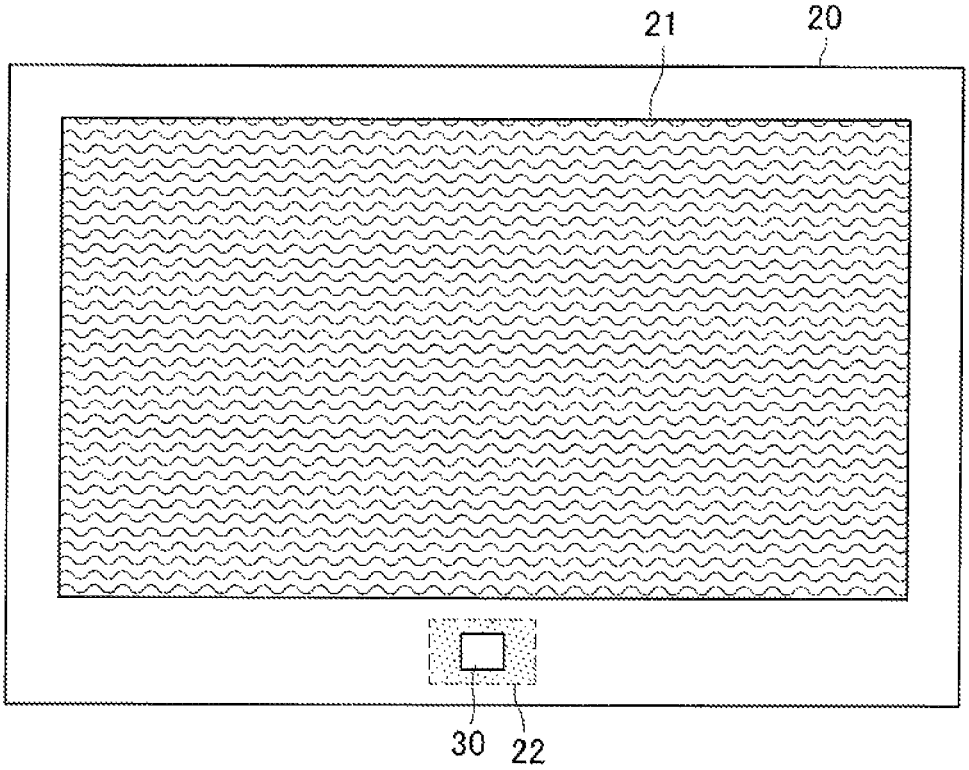
FIG. 2 is a plan view illustrating a configuration of a display panel and the like according to an embodiment.

The display panel 20 is a self-emitting device driven in a line-sequential manner, for example, and includes the display region 21 and dummy pixel region 22 as illustrated in FIG. 1 and FIG. 2. The display region 21 is a region seen by the user and displays an image according to the image signal. In addition, the display region 21 is also referred to as an effective pixel region. The display region 21 includes a plurality of pixels and the pixel signal is input in each pixel. Each pixel includes a display element and a drive circuit driving the display element (for example, a TFT circuit). The display region 21 generates heat due to the electricity turned on (that is, due to the image signal input). On the other hand, since the display region 21 can be touched by the user as mentioned above, the maximum value of the absolute temperature (temperature of the display region) is often regulated strictly. Therefore, the temperature of the display region is expected to be suppressed not more than the predetermined value.

The dummy pixel region 22 is provided in a region different from the display region 21. Specifically, the dummy pixel region 22 locates at the position where it is not seen by the user and light from the dummy pixel region 22 does not reach the display region 21.

The dummy pixel region 22 has the same configuration as that of the display region 21, and is used as a representative region of the display region 21. Namely, the dummy pixel region 22 includes a plurality of pixels and the signal for temperature detection is input in each pixel. In addition, the dummy pixel region 22 may include a single pixel, and however, the dummy pixel region 22 is preferable to include a plurality of pixels in consideration of dispersion of temperature and the like. Each pixel includes a display element and a drive circuit driving the display element (for example, a TFT circuit). Temperature characteristics of these pixels (correlation between the signal level and temperature) are the same as the temperature characteristics of the pixels included in the display region 21. Accordingly, detecting the temperature of the dummy pixel region 22 enables to estimate the temperature of the display region 21.

Figure 3:
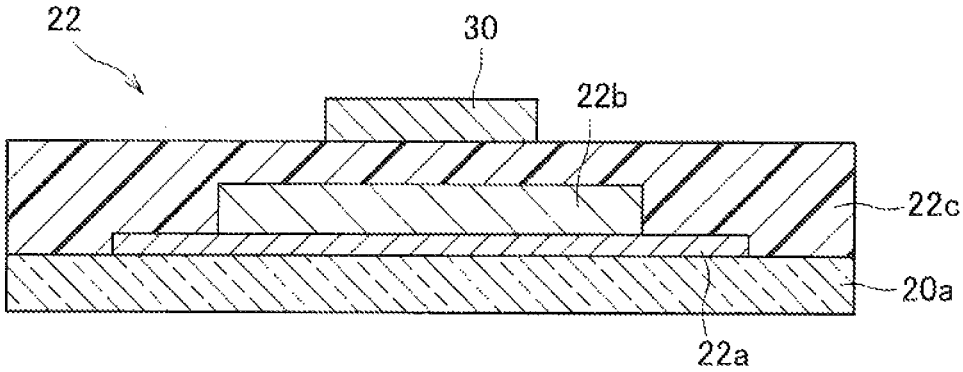
FIG. 3 is a lateral cross-sectional view illustrating one example of arrangement of a temperature sensor.

FIG. 3 illustrates a specific configuration of the dummy pixel region 22. The dummy pixel region 22 includes a drive circuit layer 22*a*, a light-emitting layer 22*b* and a resin layer 22*c*. The drive circuit layer 22*a* is a layer in which the drive circuits included in the individual pixels are disposed, and is provided on a glass substrate 20*a* of the display panel 20. The light-emitting layer 22*b* is a layer in which light-emitting elements included in the individual pixels are disposed. The resin layer 22*c* protects the drive circuit layer 22*a* and light-emitting layer 22*b*.

The temperature sensor 30 is provided in the center portion of the dummy pixel region 22, and detects the temperature of the dummy pixel region 22. Then, the temperature sensor 30 generates the dummy temperature information regarding the temperature of the dummy pixel region 22, and outputs it to the image controller 14.

FIG. 3 illustrates a specific example of location of the temperature sensor 30. In this example, the temperature sensor 30 is a contact temperature sensor. Moreover, the temperature sensor 30 is provided on the light-emitting layer 22*b* side, not on the glass substrate 20*a* side. Namely, the temperature sensor 30 detects the temperature of the dummy pixel region 22 from the image display plane side of the dummy pixel region 22.

Figure 4:
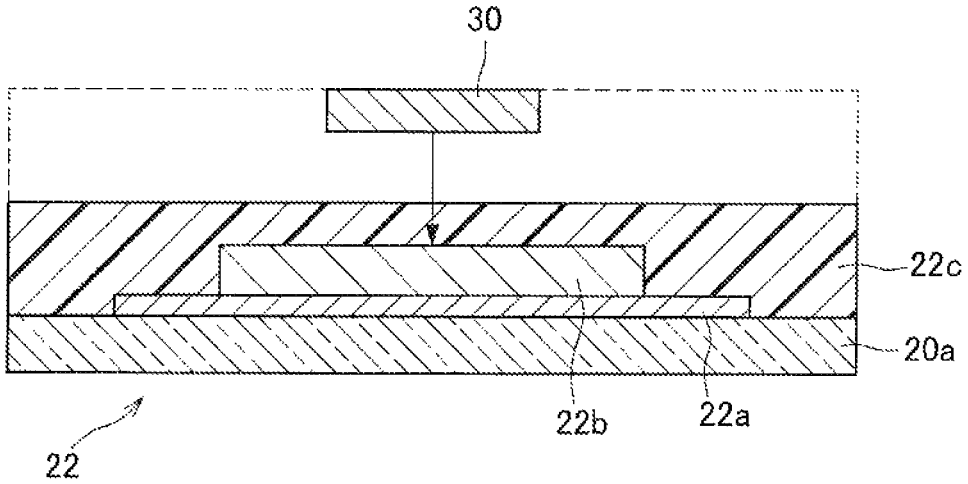
FIG. 4 is a lateral cross-sectional view illustrating one example of arrangement of the temperature sensor.

FIG. 4 illustrates another example of the location of the temperature sensor 30. In this example, the temperature sensor 30 is a non-contact temperature sensor (for example, an infrared temperature sensor). Moreover, the temperature sensor 30 is provided on the light-emitting layer 22*b* side, not on the glass substrate 20*a* side. Namely, the temperature sensor 30 detects the temperature of the dummy pixel region 22 from the image display plane side of the dummy pixel region 22. Moreover, since the temperature sensor 30 operates in a non-contact manner, it is provided apart from the resin layer 22*c*. The temperature sensor 30 irradiates the light-emitting layer 22*b* with infrared light, for example, and measures the temperature of the dummy pixel region 22 on the basis of the reflected infrared light.

Figure 5:
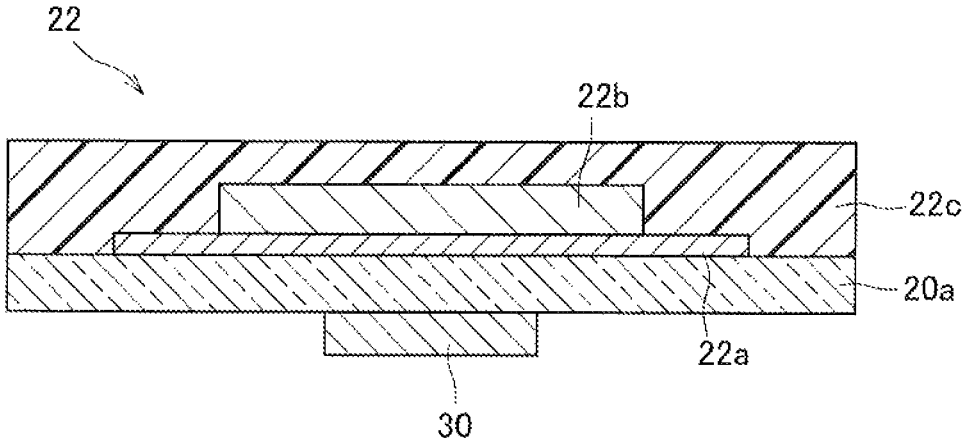
FIG. 5 is a lateral cross-sectional view illustrating one example of arrangement of the temperature sensor.

FIG. 5 illustrates another example of the location of the temperature sensor 30. In this example, the temperature sensor 30 is a contact temperature sensor. Moreover, the temperature sensor 30 is provided on the glass substrate 20*a* side. Namely, the temperature sensor 30 detects the temperature of the dummy pixel region 22 from the rear face side of the dummy pixel region 22.

Out of the above-mentioned examples, the example illustrated in FIG. 4 is most preferable. In the example illustrated in FIG. 4, the temperature sensor 30 can perform the detection from the image display plane side of the dummy pixel region 22. Moreover, since the temperature sensor 30 operates in a non-contact manner, it does not disturb heat dissipation from the dummy pixel region 22. Namely, in the example illustrated in FIG. 4, the environment surrounding the dummy pixel region 22 is almost identical with the environment surrounding the display region 21. Accordingly, the temperature measured by the temperature sensor 30 is closer to the temperature of the display region 21.

The next preferable example is the example illustrated in FIG. 3, because the temperature sensor 30 can perform the detection from the image display plane side of the dummy pixel region 22 in the example illustrates in FIG. 3, even in consideration of heat resistance due to the resin layer 22*c*. In the example illustrates in FIG. 5, although the temperature sensor 30 is affected by the glass substrate 20*a* (for example, thermal dispersion due to the glass substrate 20*a* and the like), it can detect the temperature of the dummy pixel region 22 more accurately than the estimation from the environmental temperature. Accordingly, also in applying the example illustrated in FIG. 5, the embodiment works well.

[2-2. Procedure of Processing by Display Control Apparatus]

Figure 6:
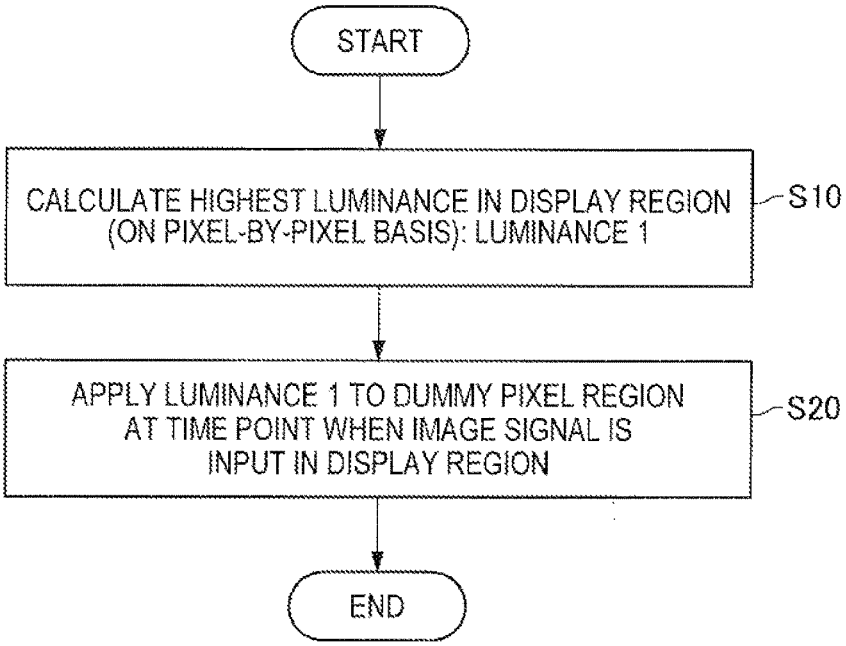
FIG. 6 is a flowchart illustrating a procedure of processing by the display control apparatus.

Next, a procedure of the processing by the display control apparatus 10 is described with reference to a flowchart illustrated in FIG. 6.

In step S10, the signal detector 11 detects the image signal at the current frame and outputs it to the image correction part 12 and image controller 14. Next, the image controller 14 detects the peak pixel signal from the image signal. Namely, the image controller 14 detects the highest signal level of the pixel signal (highest luminance; luminance 1).

Next, the image controller 14 acquires the dummy temperature information and determines whether or not the correction should be performed, on the basis of the dummy temperature information. In addition, at the time point when the image controller 14 acquires the dummy temperature information, the dummy pixel region 22 is generating heat according to the signal for temperature detection input at the previous frame.

Specifically, the image controller 14 determines whether or not the temperature of the dummy pixel region 22 is equal to or smaller than a predetermined value, on the basis of the dummy temperature information. Then, when the temperature of the dummy pixel region 22 exceeds the predetermined value, the image controller 14 determines that the correction should be performed, and when the temperature of the dummy pixel region 22 is equal to or smaller than the predetermined value, it determines that the correction does not have to be performed.

Then, when it is determined that the correction should be performed, the image controller 14 generates the correction information regarding the peak pixel signal and gain coefficient G_Peak, and outputs it to the image correction part 12. On the other hand, when it is determined that the correction does not have to be performed, the image controller 14 outputs no-correction information regarding the peak pixel signal to the image correction part 12.

Next, when the image correction part 12 acquires the correction information from the image controller 14, it corrects the image signal on the basis of the correction information. Specifically, the image correction part 12 extracts the peak pixel signal from the image signal and multiplies the signal level of the peak pixel signal by the gain coefficient G_Peak, and thereby, calculates the correction signal level. Then, the image correction part 12 sets the signal level of the peak pixel signal to the correction signal level. Thereby, the image correction part 12 corrects the image signal. Namely, in the first embodiment, the peak value in signal level is detected on a pixel-by-pixel basis and this peak value is smoothed, and thereby, the image signal is corrected. Thereby, the temperature of the display region 21 is reduced. The image correction part 12 outputs the image signal after the correction to the panel driver 13. Moreover, the image correction part 12 generates the signal for temperature detection having the correction signal level, and outputs it to the panel driver 13.

On the other hand, when the image correction part 12 acquires the no-correction information, it outputs the image signal to the panel driver 13 as it is. Moreover, the image correction part 12 extracts the peak pixel signal from the image signal, generates the signal for temperature detection having the signal level of the peak pixel signal, that is, the highest signal level, and outputs it to the panel driver 13. Accordingly, in the first embodiment, even when the correction does not have to be performed, the dummy pixel region 22 is allowed to generate heat. Thereby, the temperature of the dummy pixel region 22 can be monitored more accurately.

In step S20, the panel driver 13 inputs the image signal given from the image correction part 12 in the display region 21. Moreover, the panel driver 13 inputs the signal for temperature detection in the dummy pixel region 22 at the time point when the image signal is input in the display region 21. Thereby, the dummy pixel region 22 generates heat. The temperature of the dummy pixel region 22 is used for the processing at the next frame.

In addition, the display control apparatus 10 may perform the processing in steps S10 and S20 for all the frames, and may perform for predetermined frames. This applies for embodiments and variations mentioned later.

As above, in the first embodiment, the display control apparatus 10 can detect the temperature of the dummy pixel region 22. Then, the display control apparatus 10 inputs the signal for temperature detection in the dummy pixel region 22, and adjusts the signal level of the image signal on the basis of the temperature of the dummy pixel region. Accordingly, the display control apparatus 10 can control (detect) the temperature of the display region 21 accurately, and in addition, can suppress the temperature of the display region 21 not more than a predetermined value.

Furthermore, in the first embodiment, since the temperature of the display region 21 can be detected only by addition of the temperature sensor 30 to the dummy pixel region 22, a simpler configuration enables to detect the temperature of the display region 21. Accordingly, in the first embodiment, costs can be reduced.

Furthermore, since the display control apparatus 10 sets the signal level of the signal for temperature detection to the highest signal level of the peak pixel signal, the temperature of the display region 21 can be securely suppressed not more than a predetermined value.

Furthermore, since the display control apparatus 10 detects the temperature of the dummy pixel region 22 from the image display plane side of the dummy pixel region 22, the temperature of the display region 21 can be securely suppressed not more than a predetermined value.

[2-3. Variation]

Next, a variation of the first embodiment is described. As illustrated in FIG. 2, in the first embodiment, the dummy pixel region 22 is provided below the display region 21. Meanwhile, the display panel 20 tends to have higher temperature at its upper portion, because hot air generated in the display control apparatus 10 moves upward. Accordingly, there is a case where the difference between temperatures at the top end and at the bottom end of the display region 21 becomes large. Therefore, control should sometimes be performed according to the balance between the temperature at the top end and the temperature at the bottom end.

Figure 7:
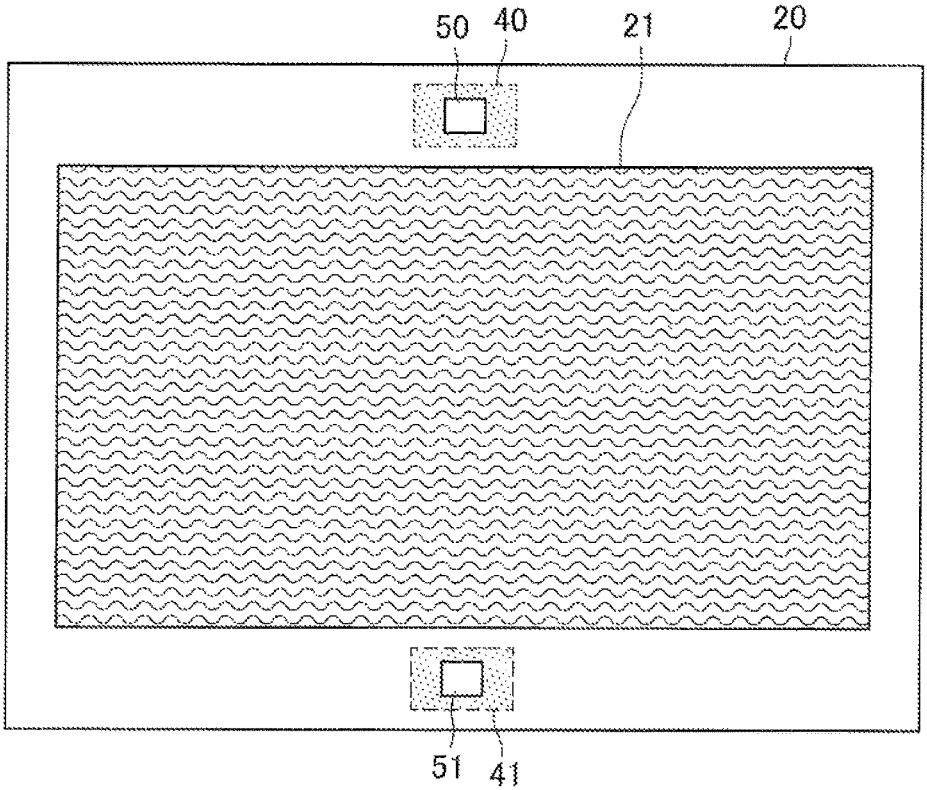
FIG. 7 is a plan view illustrating the display panel and the like according to a variation of an embodiment.

Hence, in this variation, dummy pixel regions 40 and 41 and temperature sensors 50 and 51 corresponding to these are provided above and below the display region 21, respectively, as illustrated in FIG. 7. The panel driver 13 inputs the identical signals for temperature detection in the dummy pixel regions 40 and 41. Namely, the dummy pixel regions 40 and 41 and the temperature sensors 50 and 51 are provided for the same purpose.

The image controller 14 calculates an average value or a maximum value of temperatures of the dummy pixel regions 40 and 41 on the basis of temperature information given from the temperature sensors 50 and 51. Herein, the image controller 14 selectively employs the average value or the maximum value according to the situation and characteristics of the display panel 20.

For example, the temperature of the dummy pixel region 40 tends to be higher than the temperature of the dummy pixel region 41, because the dummy pixel region 40 is disposed near the top end of the display region 21 and the dummy pixel region 41 is disposed near the bottom end of the display region 21. Accordingly, when the image controller 14 employs the maximum value, the image controller 14 substantially employs the temperature of the dummy pixel region 40. However, when the temperature difference between the dummy pixel region 40 and dummy pixel region 41 is exceedingly large, the temperature of the dummy pixel region 40 is exceedingly larger than the temperature of the display region 21, especially, the temperature at its bottom end.

Accordingly, when the image controller 14 adjusts the image signal on the basis of the temperature of the dummy pixel region 40, this means that it performs the adjustment with a margin to the actual temperature of the display region 21. Even in this case, the image controller 14 can suppress the temperature of the display region 21 not more than the predetermined value. The above-mentioned margin, however, is preferable to be smaller, because the excessive correction of the image signal is desirable to be suppressed.

Therefore, when the temperature difference between the dummy pixel region 40 and dummy pixel region 41 is within a predetermined range, the image controller 14 adjusts the image signal on the basis of the maximum value of the temperatures of the dummy pixel regions 40 and 41 (substantially, the temperature of the dummy pixel region 40). On the other hand, when the temperature difference is beyond the predetermined range, the image controller 14 adjusts the image signal on the basis of the average value of the temperatures of the dummy pixel regions 40 and 41. Thereby, the image controller 14 can suppress the temperature of the display region 21 not more than a predetermined value, and in addition, can reduce the margin. Namely, the image controller 14 can perform the control according to the balance between the temperature at the top end and the temperature at the bottom end of the display region 21. In addition, the adjustment method of the image signal is same as that in the first embodiment.

Schematically, the image controller 14 determines whether or not the maximum value or the average value of the temperatures exceeds a predetermined value, and when the maximum value or the average value of the temperatures exceeds the predetermined value, it outputs the above-mentioned correction information to the image correction part 12.

As above, in this variation, the display control apparatus 10 inputs the signals for temperature detection at the identical signal level in the dummy pixel regions 40 and 41, and adjusts the signal level of the pixel signal on the basis of the average value of the temperatures of the dummy pixel regions 40 and 41. Accordingly, the display control apparatus 10 can securely suppress the temperature of the display region 21 not more than a predetermined value.

Moreover, the display control apparatus 10 inputs the signals for temperature detection at the identical signal level in the dummy pixel regions 40 and 41, and adjusts the signal level of the pixel signal on the basis of the maximum value of the temperatures of the dummy pixel regions 40 and 41. Accordingly, the display control apparatus 10 can securely suppress the temperature of the display region 21 not more than the predetermined value. In addition, this variation may be applied to the second embodiment mentioned later. In this case, the signal for temperature detection input in each dummy temperature region is to have the highest signal level out of average signal levels of partitioned regions 21*a*.

3. Second Embodiment

[3-1. Configuration of Display Control Apparatus]

Figure 8:
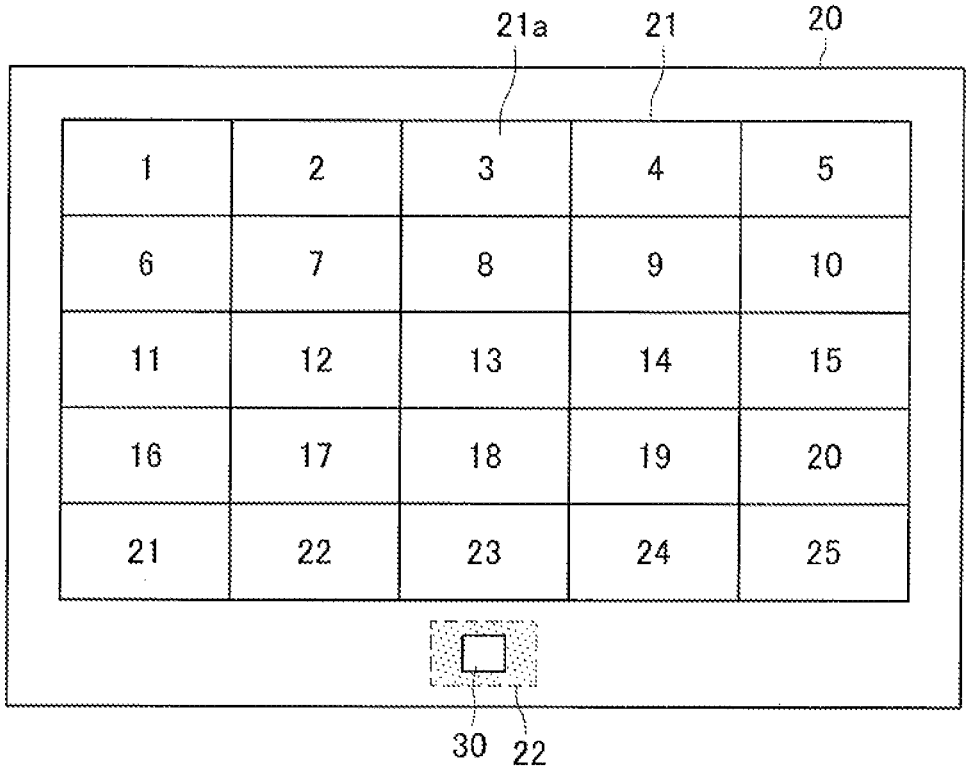
FIG. 8 is a plan view illustrating a configuration of the display panel and the like according to an embodiment.

Next, a configuration of the display control apparatus 10 according to a second embodiment is described on the basis of FIG. 8. In addition, its difference from that in the first embodiment is described herein. As illustrated in FIG. 8, in the second embodiment, the display region 21 is divided into a plurality of partitioned regions (blocks) 21*a*. Also in addition, in FIG. 8, the display region 21 is divided into 25 partitioned regions 21*a*, whereas the number of the partitioned regions 21*a* is not limited to this. Preferably, the number of the partitioned regions 21*a* is far more than 25. Each partitioned region 21*a* includes at least two pixels. As mentioned later, the dimensions of the partitioned region 21*a* are preferable to be smaller than those of the dummy pixel region 22.

The image controller 14 calculates average signal levels of pixel signals input in the partitioned regions 21*a*, and detects the partitioned region 21*a* with the average signal level which is the largest signal level (hereinafter, also referred to as "peak partitioned region"). Namely, the image controller 14 detects the highest signal level out of the average signal levels. The image controller 14 generates correction information regarding the peak partitioned region and a gain coefficient G_Peak, and outputs it to the image correction part 12. Herein, the gain coefficient G_Peak is a value same as in the first embodiment. Accordingly, the image controller 14 is to adjust the signal level of the peak partitioned region.

When the image correction part 12 acquires the correction information, it corrects the image signal on the basis of the correction information. Specifically, the image correction part 12 multiplies the signal level of the image signal input in the peak partitioned region by the gain coefficient G_Peak, and thereby, calculates a correction signal level. Then, the image correction part 12 sets the signal level of the peak partitioned region to the correction signal level. Thereby, the image correction part 12 corrects the image signal. The image correction part 12 outputs the image signal after the correction to the panel driver 13. Moreover, the image correction part 12 generates a signal for temperature detection having the correction signal level, and outputs it to the panel driver 13.

Namely, in the second embodiment, a peak value in signal level is detected on a block-by-block basis (on a partitioned region-by-partitioned region basis) and this peak value is smoothed, and thereby, the image signal is corrected. Thereby, the temperature of the display region 21 is reduced. The reason for such processing is as follows.

Namely, in the first embodiment, the signal level of the signal for temperature detection is set to the signal level of the peak pixel signal. However, since the pixel in which the peak pixel signal is input, that is, the peak pixel is different for each image signal, the peak pixel moves frequently. Moreover, the temperature of the peak pixel is distributed to the surrounding pixels. Moreover, the peak pixel is small and susceptible to the surrounding environment. Accordingly, the signal level of the peak pixel sometimes does not affect the temperature of the display region 21.

Moreover, in this case, the temperature of the dummy pixel region 22 is higher than the temperature of the peak pixel, because the temperature of the dummy pixel region 22, which includes a plurality of pixels, disperses to a less extent than the peak pixel. Accordingly, the image controller 14 performs the adjustment with a margin to the actual temperature of the display region 21. However, as mentioned above, the margin is preferable to be smaller.

On the other hand, in the second embodiment, the signal level of the signal for temperature detection is set to the signal level of the peak partitioned region. The temperature of the peak partitioned region, which includes at least plurality of pixels, disperses to a less extent than the peak pixel. Accordingly, the temperature of the peak partitioned region is closer to the temperature of the dummy pixel region 22. In other words, the margin can be small. Accordingly, in the second embodiment, the temperature of the display region 21 can be controlled more accurately.

The dimensions of the partitioned region 21*a* are determined according to the above-mentioned context. Specifically, the dimensions of the partitioned region 21*a* are dimensions in which a temperature gradient of the partitioned region 21*a* (correlation between the signal level and temperature) is identical with a temperature gradient of dummy pixel region 22. Thereby, since the temperature of the dummy pixel region 22 is identical with the temperature of the peak partitioned region, the image controller 14 can control the temperature of the display region 21 more accurately.

Moreover, the partitioned region 21*a* is preferable to be smaller than the dummy pixel region 22. The reason is as follows. Namely, in case where the partitioned region 21*a* is larger than the dummy pixel region 22, when the pixel signals at the identical signal level are input in these, the temperature of the dummy pixel region 22 is lower than the temperature of the partitioned region 21*a*. Furthermore, since the surroundings of the dummy pixel region 22 are not light-emitting, the temperature of the dummy pixel region 22 disperses more than the temperature of the partitioned region 21*a*. When the temperature of the dummy pixel region 22 is lower than the temperature of the partitioned region 21*a*, a difference between the temperature of the dummy pixel region 22 and the temperature of the partitioned region 21*a* should be considered in order that the image controller 14 suppresses the temperature of the display region 21 not more than a predetermined value. Accordingly, it is time-consuming that the image controller 14 controls the temperature of the display region 21.

On the other hand, in case where the partitioned region 21*a* is smaller than the dummy pixel region 22, when the pixel signals at the identical signal level are input in these, the temperature of the dummy pixel region 22 is equal to or higher than the temperature of the partitioned region 21*a*. Accordingly, the image controller 14 can control the temperature of the display region 21 more precisely and accurately. Moreover, the dimensions of the partitioned region 21*a* are preferable to be as small as possible.

[3-2. Procedure of Processing by Display Control Apparatus]

Figure 9:
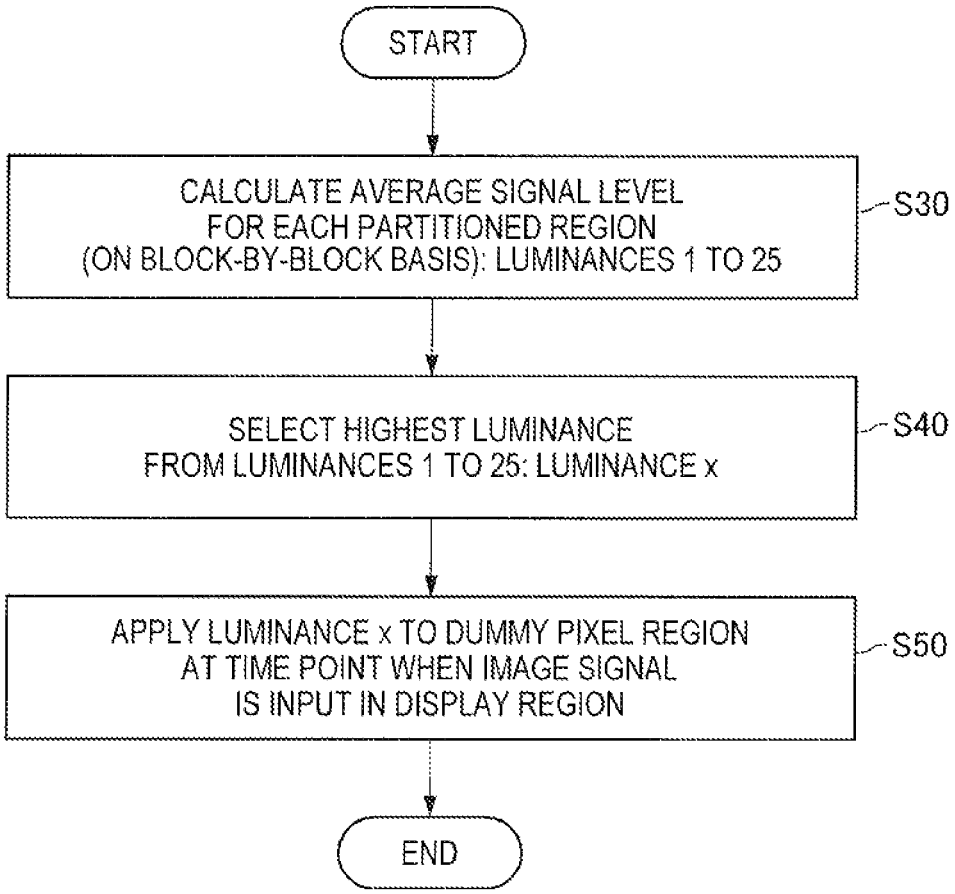
FIG. 9 is a flowchart illustrating a procedure of processing by the display control apparatus.

Next, a procedure of the processing by the display control apparatus 10 is described with reference to a flowchart illustrated in FIG. 9. First, in step S30, the signal detector 11 detects the image signal at the current frame and outputs it to the image correction part 12 and image controller 14. Next, the image controller 14 acquires the dummy temperature information from the temperature sensor 30. In addition, at the time point when the image controller 14 acquires the dummy temperature information, the dummy pixel region 22 is generating heat according to the signal for temperature detection input at the previous frame.

Next, the image controller 14 calculates average signal levels (luminances 1 to 25) of pixel signals input in the partitioned regions 21*a*. Next, in step S40, the image controller 14 detects the partitioned region 21*a* with the average signal level which is the largest signal level (luminance x), that is, the peak partitioned region. Namely, the image controller 14 detects the highest signal level out of the average signal levels.

Next, the image controller 14 determines whether or not the correction should be performed, on the basis of the dummy temperature information. The specific processing is same as in the first embodiment. When it is determined that the correction should be performed, the image controller 14 generates the correction information regarding the peak partitioned region and gain coefficient G_Peak, and outputs it to the image correction part 12. On the other hand, when it is determined that the correction does not have to be performed, the image controller 14 outputs the no-correction information regarding the peak partitioned region to the panel driver 13.

Next, when the image correction part 12 acquires the correction information from the image controller 14, it corrects the image signal on the basis of the correction information. Specifically, the image correction part 12 multiplies the signal level of the image signal input in the peak partitioned region by the gain coefficient G_Peak, and thereby, calculates the correction signal level. Then, the image correction part 12 sets the signal level of the peak partitioned region to the correction signal level. Thereby, the image correction part 12 corrects the image signal. The image correction part 12 outputs the image signal after the correction to the panel driver 13. Moreover, the image correction part 12 generates the signal for temperature detection having the average signal level at the correction 12 signal level, outputs it to the panel driver 13.

On the other hand, when the image correction part acquires the no-correction information, it outputs the image signal to the panel driver 13 as it is. Moreover, the image correction part 12 generates the signal for temperature detection having the average signal level of the image signal input in the peak partitioned region, and outputs it to the panel driver 13. Accordingly, in the second embodiment, even when the correction does not have to be performed, the dummy pixel region 22 is allowed to generate heat. Thereby, the temperature of the dummy pixel region 22 can be monitored more accurately.

In step S50, the panel driver 13 inputs the image signal given from the image correction part 12 in the display region 21. Moreover, the panel driver 13 inputs the signal for temperature detection to the dummy pixel region 22 at the time point when the image signal is input in the display region 21. Thereby, the dummy pixel region 22 generates heat. The temperature of the dummy pixel region 22 is used for the processing at the next frame.

As above, in the second embodiment, since the signal level of signal for temperature detection is set to the highest signal level out of the average signal levels, the display control apparatus 10 can control (detect) the temperature of the display region 21 more accurately.

4. Third Embodiment

[4-1. Configuration of Display Control Apparatus]

Figure 10:
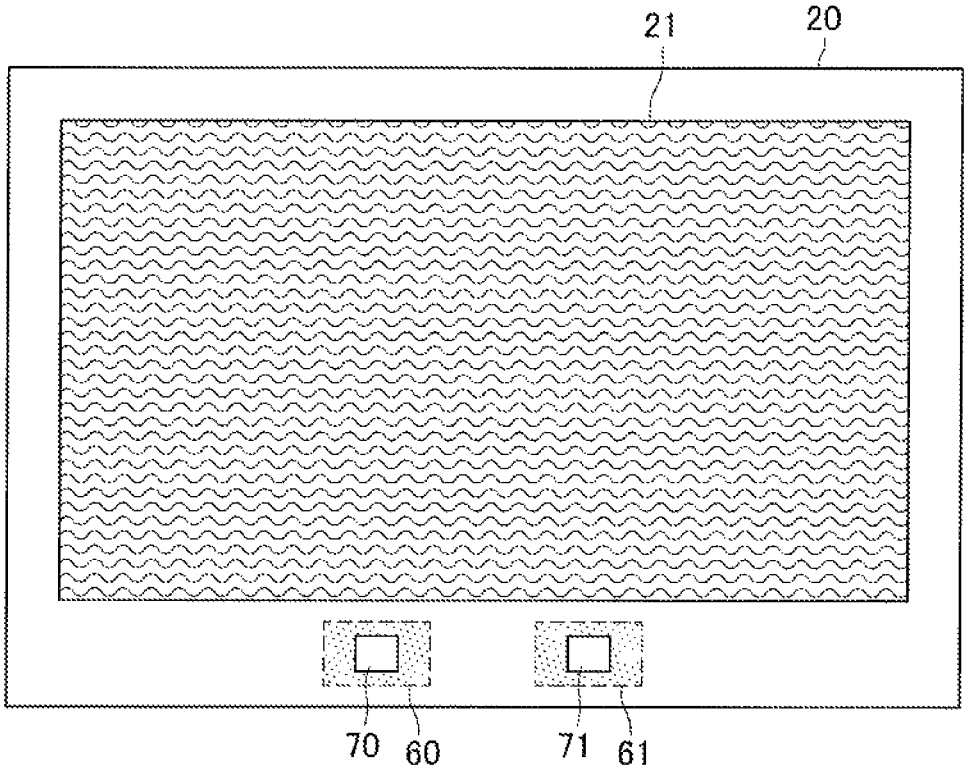
FIG. 10 is a plan view illustrating a configuration of the display panel and the like according to an embodiment.

Next, a configuration of the display control apparatus 10 according to a third embodiment is described on the basis of FIG. 10. In addition, its difference from that in the first embodiment is described herein. As illustrated in FIG. 10, dummy pixel regions 60 and 61 and temperature sensors 70 and 71 corresponding to these are provided below the display region 21.

The image controller 14 detects the peak pixel signal from the image signal. Namely, the image controller 14 detects the highest signal level of the pixel signal.

The, the image controller 14 acquires first dummy temperature information from the temperature sensor 70 and acquires second dummy temperature information from the temperature sensor 71. Then, the image controller 14 determines whether or not the correction should be performed, on the basis of these pieces of dummy temperature information. Specifically, the image controller 14 determines whether or not the temperatures of the dummy pixel regions 60 and 61 are equal to or smaller than a predetermined value. Herein, a signal for temperature detection having the signal level of the peak pixel signal is input in the dummy pixel region 60, and a signal for temperature detection having an overall average signal level (average signal level of all the pixel signals) is input in the dummy pixel region 61 as mentioned later.

Then, when the temperature of the dummy pixel region 60 or the dummy pixel region 61 exceeds a predetermined value, the image controller 14 determines that the correction should be performed, and when both of the temperatures of the dummy pixel regions 60 and 61 are equal to or smaller than the predetermined value, it determines that the correction does not have to be performed. Then, when it is determined that the correction should be performed, the image controller 14 further determines which of first correction and second correction should be performed. The first correction is correction in which the peak pixel signal is multiplied by the gain coefficient G_Peak, and the second correction is correction in which the overall average signal level is multiplied by a gain coefficient G_Ave. Herein, the gain coefficient G_Ave is a value less than 1. The gain coefficient G_Ave may be preset, whereas it may be calculated every time. The specific calculation method is same as in the first embodiment.

When the temperature of the dummy pixel region 60 is far larger than the temperature of the dummy pixel region 61 (the difference between these is larger than a predetermined determination reference value), the image controller 14 determines that the first correction should be performed. On the other hand, when the temperature of the dummy pixel region 60 is equal to or greater than the temperature of the dummy pixel region 61, the image controller 14 determines that the second correction should be performed.

When it is determined that the first correction should be performed, the image controller 14 generates first correction information regarding the peak pixel signal and gain coefficient G_Peak, and outputs it to the image correction part 12. On the other hand, when it is determined that the second correction should be performed, the image controller 14 generates second correction information regarding the peak pixel signal and gain coefficient G_Ave, and outputs it to the image correction part 12.

When the image correction part 12 acquires the first correction information, it corrects the image signal on the basis of the first correction information. Specifically, the image correction part 12 extracts the peak pixel signal from the image signal and multiplies the signal level of the peak pixel signal by the gain coefficient G_Peak, and thereby, calculates the correction signal level. Then, the image correction part 12 sets the signal level of the peak pixel signal to the correction signal level. Thereby, the image correction part 12 corrects the image signal.

The image correction part 12 outputs the image signal after the correction to the panel driver 13. Moreover, the image correction part 12 generates a first signal for temperature detection having the correction signal level, and outputs it to the panel driver 13. Moreover, the image correction part 12 calculates the arithmetic mean of the signal levels of all the pixel signals included in the image signal after the correction, and thereby, calculates the overall average signal level. Then, the image correction part 12 generates a second signal for temperature detection having the overall average signal level, and outputs it to the panel driver 13. In addition, since the first correction is correction for the peak pixel signal, the overall average signal level is substantially maintained.

When the image correction part 12 acquires the second correction information, it corrects the image signal on the basis of the second correction information. Specifically, the image correction part 12 multiplies all the pixel signals by the gain coefficient G_Ave, and thereby, calculates the correction signal level for each pixel signal. Then, the image correction part 12 sets the signal level of each pixel signal to the correction signal level. Thereby, the image correction part 12 corrects the image signal.

The image correction part 12 outputs the image signal after the correction to the panel driver 13. Moreover, the image correction part 12 detects the pixel with the peak pixel signal, that is, the peak pixel on the basis of the second correction information. Then, the image correction part 12 generates the first signal for temperature detection having the correction signal level of the peak pixel, and outputs it to the panel driver 13. Moreover, the image correction part 12 calculates the arithmetic mean of the signal levels of all the pixel signals included in the image signal after the correction, and thereby, calculates the overall average signal level. Then, the image correction part 12 generates the second signal for temperature detection having the overall average signal level, and outputs it to the panel driver 13. In addition, since the second correction is performed for all the pixel signals, the overall average signal level decreases before the correction.

The panel driver 13 inputs the image signal given from the image correction part 12 in the display region 21, and at this time point, outputs the first signal for temperature detection to the dummy pixel region 60 and the second signal for temperature detection to the dummy pixel region 61.

[4-2. Procedure of Processing by Display Control Apparatus]

Figure 11:
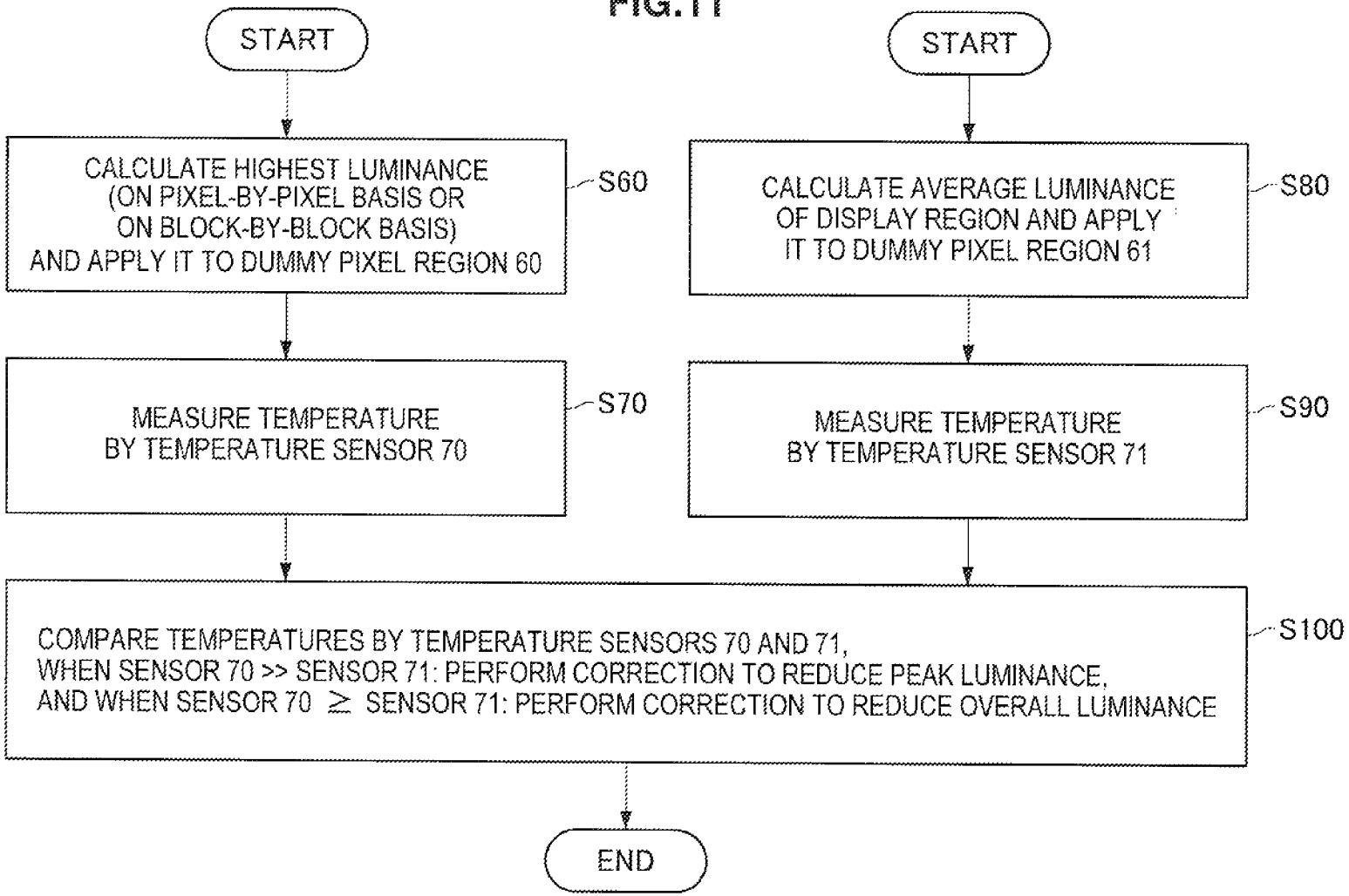
FIG. 11 is a flowchart illustrating a procedure of processing by the display control apparatus.

Next, a procedure of the processing by the display control apparatus 10 is described with reference to a flowchart illustrated in FIG. 11. In addition, the processing before the correction is described. First, the signal detector 11 detects the image signal (at the current frame) and outputs it to the image correction part 12.

Next, in step S60, the image correction part 12 extracts the peak pixel signal from the image signal and generates the first signal for temperature detection having the signal level of the peak pixel signal. The image correction part 12 outputs the image signal to the panel driver 13. Moreover, the image correction part 12 generates the first signal for temperature detection and output it to the panel driver 13.

Next, the panel driver 13 inputs the image signal given from the image correction part 12 in the display region 21, and at this time point, outputs the first signal for temperature detection to the dummy pixel region 60.

In step S70, the temperature sensor 70 detects the temperature of the dummy pixel region 60 and outputs first temperature information to the image controller 14.

On the other hand, in step S80, the image correction part 12 calculates the arithmetic mean of the signal levels of all the pixel signals included in the image signal, and thereby, calculates the overall average signal level. Then, the image correction part 12 generates the second signal for temperature detection having the overall average signal level, and outputs it to the panel driver 13.

Next, at the time point when the image signal given from the image correction part 12 is input in the display region 21, the panel driver 13 outputs the second signal for temperature detection to the dummy pixel region 61.

In step S90, the temperature sensor 71 detects the temperature of the dummy pixel region 61 and outputs second temperature information to the image controller 14. The processing in steps S60 and S70 and the processing in steps S80 and S90 are performed in parallel.

In step S100, the signal detector 11 detects the image signal (at the next frame) and outputs it to the image correction part 12 and image controller 14. The image controller 14 detects the peak pixel signal from the image signal. Namely, the image controller 14 detects the highest signal level of the pixel signal.

Then, the image controller 14 determines whether or not the correction should be performed, on the basis of the first dummy temperature information and second dummy temperature information. Specifically, when the temperature of the dummy pixel region 60 or the dummy pixel region 61 exceeds a predetermined value, the image controller 14 determines that the correction should be performed. On the other hand, when both of the temperatures of the dummy pixel regions 60 and 61 are equal to or smaller than the predetermined value, the image controller 14 determines that the correction does not have to be performed. Then, when it is determined that the correction should be performed, the image controller 14 further determines which of the first correction and the second correction should be performed.

When the temperature of the dummy pixel region 60 is far larger than the temperature of the dummy pixel region 61, the image controller 14 determines that the first correction should be performed. On the other hand, when the temperature of the dummy pixel region 60 is equal to or greater than the temperature of the dummy pixel region 61, the image controller 14 determines that the second correction should be performed.

When it is determined that the first correction should be performed, the image controller 14 generates the first correction information regarding the peak pixel signal and gain coefficient G_Peak, and outputs it to the image correction part 12. On the other hand, when it is determined that the second correction should be performed, the image controller 14 generates the second correction information regarding the peak pixel signal and gain coefficient G_Ave, and outputs it to the image correction part 12. In addition, when it is determined that the correction does not have to be performed, the image controller 14 outputs the no-correction information same as in the first embodiment to the image correction part 12.

When the no-correction information is acquired, the image correction part 12 and panel driver 13 perform the above-mentioned processing same as in steps S60 to S90.

On the other hand, when the image correction part 12 acquires the first correction information, it corrects the image signal on the basis of the first correction information. Specifically, the image correction part 12 extracts the peak pixel signal from the image signal and multiplies the signal level of the peak pixel signal by the gain coefficient G_Peak, and thereby, calculates the correction signal level. Then, the image correction part 12 sets the signal level of the peak pixel signal to the correction signal level. Thereby, the image correction part 12 corrects the image signal.

The image correction part 12 outputs the image signal after the correction to the panel driver 13. Moreover, the image correction part 12 generates the first signal for temperature detection having the correction signal level, and outputs it to the panel driver 13. Moreover, the image correction part 12 calculates the arithmetic mean of the signal levels of all the pixel signals included in the image signal after the correction, and thereby, calculates the overall average signal level. Then, the image correction part 12 generates the second signal for temperature detection having the overall average signal level, and outputs it to the panel driver 13.

When the image correction part 12 acquires the second correction information, it corrects the image signal on the basis of the second correction information. Specifically, the image correction part 12 multiplies all the pixel signals by the gain coefficient G_Ave, and thereby, calculates the correction signal level for each pixel signal. Then, the image correction part 12 sets the signal level of each pixel signal to the correction signal level. Thereby, the image correction part 12 corrects the image signal.

The image correction part 12 outputs the image signal after the correction to the panel driver 13. Moreover, the image correction part 12 detects the pixel with the peak pixel signal, that is, the peak pixel on the basis of the second correction information. Then, the image correction part 12 generates the first signal for temperature detection having the correction signal level of the peak pixel, and outputs it to the panel driver 13. Moreover, the image correction part 12 calculates the arithmetic mean of the signal level of all the pixel signals included in the image signal after the correction, and thereby, calculates the overall average signal level. Then, the image correction part 12 generates the second signal for temperature detection having the overall average signal level, and outputs it to the panel driver 13.

The panel driver 13 inputs the image signal given from the image correction part 12 in the display region 21, and at this time point, outputs the first signal for temperature detection to the dummy pixel region 60 and the second signal for temperature detection to the dummy pixel region 61. The temperature sensor 70 measures the temperature of the dummy pixel region 60 and outputs the first temperature information to the image controller 14. The temperature sensor 71 measures the temperature of the dummy pixel region 61 and outputs the second temperature information to the image controller 14. After that, the display control apparatus 10 ends the processing. The processing in step S100 is repeated in the next and succeeding cycles. The processing in step S100 may be performed for every frame or performed for predetermined frames.

According to the third embodiment, the display control apparatus 10 sets the signal levels of the signals for temperature detection input in the individual dummy pixel regions to signal levels different from each other and that are selected from the highest signal level of the pixel signal and the overall average signal level of the pixel signal. Accordingly, the display control apparatus 10 can control (detect) the temperature of the display region 21 more accurately.

Specifically, when the highest signal level of the pixel signal is far larger than the overall average signal level, the display control apparatus 10 can perform the first correction, and when the highest signal level of the pixel signal is equal to or greater than the overall average signal level, it can perform the second correction. Accordingly, the display control apparatus 10 can control the temperature of the display region 21 in stages. Moreover, by the second correction, the temperature of the display region 21 can be reduced with the contrast of the image signal maintained.

[4-3. Variation]

Next, a variation of the third embodiment is described. In this variation, the signal level of the first signal for temperature detection employs the highest signal level out of the average signal levels which is describe in the second embodiment. In this case, the first correction is the processing same as in the second embodiment. Schematically, the image correction part 12 multiplies the signal level of the image signal input in the peak partitioned region by the gain coefficient G_Peak, and thereby, calculates the correction signal level. Then, the image correction part 12 sets the signal level of the peak partitioned region to the correction signal level. Also in this case, the same effects as in the third embodiment can be attained, and in addition, the same effects as in the second embodiment can be attained as well.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A display control apparatus including:

a dummy pixel region provided in a region different from a display region in which various images are displayed; and a temperature detector detecting a temperature of the dummy pixel region.

(2) The display control apparatus according to (1), including:

a panel driver inputting a signal for temperature detection in the dummy pixel region which is a representative region of the display region; and an adjustment part adjusting a signal level of a pixel signal input in a pixel of the display region, on the basis of the temperature of the dummy pixel region.

(3) The display control apparatus according to (2), wherein the adjustment part detects a highest signal level of the pixel signal and sets a signal level of the signal for temperature detection to the highest signal level of the pixel signal.

(4) The display control apparatus according to (2), wherein the display region is divided into a plurality of partitioned regions, and wherein the adjustment part calculates average signal levels of pixel signals input in the plurality of partitioned regions and sets a signal level of the signal for temperature detection to a highest signal level of the average signal levels.

(5) The display control apparatus according to (4), wherein a plurality of the dummy pixel regions and a plurality of the temperature detectors are provided, and wherein the adjustment part detects a highest signal level of the pixel signal input in a pixel included in the display region and sets signal levels of signals for temperature detection input in the respective dummy pixel regions to signal levels that are different from each other and that are selected from the highest signal level of the pixel signal, the highest signal level of the average signal levels, and an overall average signal level of the pixel signal.

(6) The display control apparatus according to any one of (2) to (4), wherein a plurality of the dummy pixel regions and a plurality of the temperature detectors are provided, and wherein the adjustment part inputs the signal for temperature detection at an identical signal level in each of the plurality of dummy pixel regions, and adjusts the signal level of the pixel signal on the basis of an average value of temperatures of the plurality of dummy pixel regions.

(7) The display control apparatus according to any one of (2) to (4), wherein a plurality of the dummy pixel regions and a plurality of the temperature detectors are provided, and wherein the adjustment part inputs the signal for temperature detection at an identical signal level in each of the plurality of dummy pixel regions and adjusts the signal level of the pixel signal on the basis of a maximum value of temperatures of the plurality of dummy pixel regions.

(8) The display control apparatus according to any one of (1) to (7), wherein the temperature detector detects the temperature of the dummy pixel region from an image display plane side of the dummy pixel region.

(9) A display control method including:

inputting a signal for temperature detection in a dummy pixel region provided in a region different from a display region in which various images are displayed; and adjusting a signal level of a pixel signal input in a pixel of the display region, on the basis of a temperature of the dummy pixel region.

(10) A program for causing a computer to implement:

a drive function of inputting a signal for temperature detection in a dummy pixel region provided in a region different from a display region in which various images are displayed; and an adjustment function of adjusting a signal level of a pixel signal input in a pixel of the display region, on the basis of a temperature of the dummy pixel region.

(11) A computer-readable recording medium having the program according to (10) recorded thereon.

What is claimed is:

1. A display control apparatus, comprising:

a first dummy pixel region and a second dummy pixel region in a region different from a display region, wherein a plurality of images are displayed in the display region;

a first temperature detector in the first dummy pixel region and a second temperature detector in the second dummy pixel region, wherein the first temperature detector and the second temperature detector are configured to detect a first temperature of the first dummy pixel region and a second temperature of the second dummy pixel region;

a panel driver configured to input a first pixel signal for temperature detection in at least one of the first dummy pixel region or the second dummy pixel region, wherein the first dummy pixel region and the second dummy pixel region are representative regions of the display region; and an adjustment part configured to adjust a signal level of the first pixel signal input to at least one of the first dummy pixel region or the second dummy pixel region for a current frame, wherein the first dummy pixel region and the second dummy pixel region are configured to generate heat based on a second pixel signal input at a previous frame, and wherein the signal level of the first pixel signal is adjusted based on a difference between the first temperature of the first dummy pixel region and the second temperature of the second dummy pixel region.

2. The display control apparatus according to claim 1, wherein the adjustment part is further configured to:

detect a highest signal level of the first pixel signal; and set the signal level of the first pixel signal for the temperature detection to the highest signal level of the first pixel signal.

3. The display control apparatus according to claim 1, wherein the display region is divided into a plurality of partitioned regions, and wherein the adjustment part is further configured to:

calculate an average value of a plurality of signal levels of a plurality of pixel signals input in the plurality of partitioned regions; and set the signal level of the first pixel signal for the temperature detection to a highest signal level of the calculated average value of the plurality of signal levels.

4. The display control apparatus according to claim 1, wherein the display region is divided into a plurality of partitioned regions, wherein a plurality of pixel signals are input in the plurality of partitioned regions and wherein the adjustment part is further configured to:

calculate average values of signal level of the first pixel signal input to each partition region of the plurality of partitioned regions;

detect a highest signal level of the first pixel signal input to a pixel included in the display region; and set the signal level of the first pixel signal for the temperature detection, and wherein the set signal level of the first pixel signal is selected from one of a highest signal level of the first pixel signal, a highest value of the calculated average values, or an overall average signal level of the plurality of pixel signals of an image signal.

5. The display control apparatus according to claim 1, wherein the adjustment part is further configured to:

input the first pixel signal for the temperature detection at an identical signal level to the first dummy pixel region and the second dummy pixel region; and adjust the signal level of the first pixel signal based on an average value of temperatures of the first dummy pixel region and the second dummy pixel region.

6. The display control apparatus according to claim 1, wherein the adjustment part is further configured to:

input the first pixel signal for the temperature detection at an identical signal level to the first dummy pixel region and the second dummy pixel region for the current frame; and adjust the signal level of the first pixel signal based on a maximum value of temperatures of the first dummy pixel region and the second dummy pixel region.

7. The display control apparatus according to claim 1, wherein the first temperature detector is further configured to detect the first temperature of the first dummy pixel region from an image display plane side of the first dummy pixel region.

8. The display control apparatus according to claim 1, comprising a controller configured to adjust the signal level of the first pixel signal of an image signal with a highest signal level to a correction signal level which is a product of the highest signal level and a gain co-efficient, wherein the gain co-efficient is determined based on a temperature of environment and at least one of the first temperature or the second temperature.

9. The display control apparatus according to claim 1, wherein the temperature detector is further configured to detect at least one of the first temperature of the of the first dummy pixel region or the second temperature of the second dummy pixel region from a light-emitting layer side of at least one of the first dummy pixel region or the second dummy pixel region.

10. The display control apparatus according to claim 1, wherein the temperature detector is configured to:

irradiate a light-emitting layer of at least one of the first dummy pixel region or the second dummy pixel region with infrared light; and measure the temperature of at least one of the first dummy pixel region or the second dummy pixel region based on reflected infrared light.

11. The display control apparatus according to claim 1, wherein the signal level of the first pixel signal is adjusted based on at least one of the first temperature of the first dummy pixel region or the second temperature of the second dummy pixel region that exceeds a threshold value.

12. A display control method, comprising:

inputting a first pixel signal for temperature detection in at least one of a first dummy pixel region or a second dummy pixel region, wherein the first dummy pixel region and the second dummy pixel region are in a region different from a display region, and wherein a plurality of images are displayed in the display region; and adjusting a signal level of the first pixel signal input to at least one of the first dummy pixel region or the second dummy pixel region for a current frame, wherein the first dummy pixel region and the second dummy pixel region are configured to generate heat based on a second pixel signal input at a previous frame, and wherein the signal level of the first pixel signal is adjusted based on a difference between a first temperature of the first dummy pixel region and a second temperature of the second dummy pixel region.

13. A non-transitory computer-readable medium having stored thereon computer-executable instructions that, when executed by a processor, cause a computer to execute operations, the operations comprising:

inputting a first pixel signal for temperature detection in at least one of a first dummy pixel region or a second dummy pixel region, wherein the first dummy pixel region and the second dummy pixel region are in a region different from a display region, and wherein a plurality of images are displayed in the display region; and adjusting a signal level of the first pixel signal input to the at least one of the first dummy pixel region or the second dummy pixel region for a current frame, wherein the first dummy pixel region and the second dummy pixel region are configured to generate heat based on a second pixel signal input at a previous frame, and wherein the signal level of the first pixel signal is adjusted based on a difference between a first temperature of the first dummy pixel region and a second temperature of the second dummy pixel region.

* * * * *